United States Patent [19]

Roozee

[11] 4,159,797

[45] Jul. 3, 1979

[54] SHIPPING CONTAINER AND BLANK THEREFOR

[75] Inventor: William F. Roozee, Covina, Calif.

[73] Assignee: International Paper Company, New York, N.Y.

[21] Appl. No.: 881,169

[22] Filed: Feb. 27, 1978

[51] Int. Cl.[2] ..... B65D 5/48

[52] U.S. Cl. ..... 229/27; 229/15

[58] Field of Search ..... 229/27, 28 R, 15, 28 BC

[56] References Cited

U.S. PATENT DOCUMENTS

| | | | |
|---|---|---|---|
| 1,046,337 | 12/1912 | Schoettle | 229/27 |
| 2,361,650 | 10/1944 | Potts | 229/27 |
| 2,744,675 | 5/1956 | Crane | 229/27 |
| 3,055,572 | 9/1962 | Crane | 229/27 |
| 3,100,595 | 8/1963 | Curtiss et al. | 229/27 |
| 3,127,086 | 3/1964 | Crane | 229/27 |
| 3,194,472 | 7/1965 | Crane | 229/27 |
| 3,318,204 | 5/1967 | Crane et al. | 229/15 |
| 3,829,001 | 8/1974 | Wheeler | 229/27 |
| 3,934,790 | 1/1976 | Easter | 229/27 |
| 4,018,377 | 4/1977 | Kent et al. | 229/27 |

*Primary Examiner*—William Price
*Assistant Examiner*—Joseph Man-Fu Moy
*Attorney, Agent, or Firm*—James D. Bock; Stephen P. Gilbert

[57] ABSTRACT

A tray and blank therefor constituting a shipping container with two or more open top compartments separated by a divider especially constructed to act as a strut to rigidify the tray and to support the central region of the bottom wall of the tray against bulging or sagging. The divider includes a horizontal top panel and a pair of integral vertical flaps all extending from side to side of the tray and the pair of vertical flaps also extending from fold lines along the edges of the top panel downwardly to the bottom panel thus forming a rigid hollow strut of rectangular cross section. Glue flaps integrally formed in the bottom panel are bent upwardly along spaced parallel lines into vertical planes and are adhesively secured to the inner surfaces of the vertical divider flaps inside the divider or strut. The adhesive joints by which the bottom panel is secured to the strut thus lie in vertical planes whereby the forces which would tend to make the bottom panel bulge or sag away from the strut are transferred to the strut in the shear direction of the adhesive joints, the direction in which such joints are strongest.

12 Claims, 6 Drawing Figures

SHIPPING CONTAINER AND BLANK THEREFOR

BACKGROUND

Compartmented trays, sometimes called "lugs" usually made from a single blank of corrugated fiberboard, are widely used for carrying a plurality of baskets of fragile and perishable commodities such as fruit. For example, strawberries are packed in pint or quart baskets made of wood or molded plastic which are in turn placed in groups in trays or lugs of the type here involved for distribution to the trade. A typical tray is rectangular with two open top compartments each holding a half-dozen pint baskets the contents of which will lie below the top surface of the tray to permit stacking of trays without damage to the contents. Also, conventionally, the trays have numerous strategically located openings to provide air circulation to the contents when the trays are stacked for shipment or are on individual display for retail sale.

While dividers for compartmented trays of this general type have been developed and the problem of bulging or sagging of the bottom panels has been recognized in the prior art, it does not appear that the prior art affords a connection between a divider and the bottom panel which includes adhesive joints lying in vertical planes and which thus take advantage of the superior strength exhibited by such joints when subjected primarily to shear stresses instead of tension or peeling stresses.

U.S. Pat. No. 2,744,675 discloses a tray of the general type here involved wherein a divider is formed from two flaps hinged together along a crease line to provide a hollow divider of triangular cross-section. The flaps are provided with feet which snap into slots in the bottom panel. There is no provision for support of the bottom panel by interconnection with the divider and infolding triangular gussets are relied upon to assist in holding the divider flaps in position.

U.S. Pat. No. 3,055,572 is similar to the preceding patent but provides friction holding flaps which wipe across the surface of the bottom panel to assist in holding the feet in the slots in the bottom panel. While it is not suggested in this patent, it might occur to one skilled in the art to adhesively secure the friction holding flaps to the upper surface of the bottom panel. However, such adhesive joints would be subjected to stress in the peeling direction when the bottom panel tends to bulge or sag. Furthermore, adhesive placed upon these flaps would be smeared across the bottom panel when the tray is erected causing a messy finished product, loss of glue at the joint where it is needed and impairment of bonding strength.

U.S. Pat. No. 3,127,086 is a further development of the patents described above in which glue flaps extend through an opening in the bottom panel and are glued to the underside of that panel. These would tend to prevent bulging or sagging of the bottom panel away from the divider but at least a substantial amount of the stresses placed on the adhesive joint in resisting such action are tension stresses in the peeling direction.

U.S. Pat. No. 3,194,472 also discloses glue flaps on the outside surface of the bottom panel and again the stresses placed on the adhesive joint are largely in the peeling direction.

U.S. Pat. No. 4,018,377 is a further development on the type of tray here involved. In this patent the divider is provided with a horizontal top panel along which the divider flaps are folded downwardly. Glue flaps on the bottom edges of the vertical divider flaps are bent inwardly to abut and form a generally rectangular cross-section of the divider. The glue flaps are adhesively secured to the inner, or upper, surface of the bottom panel and would resist bulging or sagging of the bottom. Again, however, the adhesive joints are subjected to peeling stresses in resisting such action and, in practice, adhesive is smeared on the surface of the bottom when the joints are formed because the glue flaps on the divider flaps result in "flaps on flaps" which are difficult to control in a high speed box erecting operation, and the glue is "flicked off" when the flaps and tabs are turned down into final position.

BRIEF DESCRIPTION OF THE INVENTION

A tray and a blank therefor is provided in which at least one divider serves to separate at least two open top compartments. Preferably, as in the prior art, the blank is made of one piece of suitable board such as a corrugated fiber board which is so designed as to be preliminarily glued along the intersection between a side wall and the bottom wall to form a tubular blank which may be shipped to the point of use in a flattened, space-saving form. Conventionally, the blank may have any suitable arrangement of end flaps which, when the flattened blank is squared up into hollow tubular form, are secured together as by adhesive and/or other means to provide multi-ply end walls, for stacking strength, with stacking tabs if desired. The blank may also have side walls which, when the tray is erected, may be joined with the end walls by angular webs which lie in planes parallel with the bottom panel and thus serve to rigidify the erected carton at the four vertical corners. The portions of the squared-up tubular blank which lie parallel with the bottom wall are cut and creased in such manner as to provide part of the end structure for each compartment. This top portion of the blank also provides the flap parts which, when the carton is erected form a vertical center divider wall in the form of a tubular strut which extends from side wall to side wall and divides the tray into its two compartments.

While details of the blank and carton so far described may be varied, the essential feature of the present invention is the manner in which the vertical flap parts forming the hollow divider strut are connected with the bottom panel for the purpose of preventing the bottom panel from bulging or sagging away from the strut. For this purpose, the present invention provides glue flaps integrally formed in the bottom panel in positions to be bent upwardly along spaced parallel lines out of the plane of the bottom panel into substantially vertical planes and which are adhesively secured to the surfaces of the vertical flap parts of the divider strut. In the preferred embodiment shown, these upwardly bent glue flaps are attached to the inner surfaces of the downwardly bent vertical flap parts of the divider strut, but, within the purview of the invention, they could also be attached to their outer surfaces. The adhesive joints thus formed lie in substantially vertical planes with respect to the plane of the bottom panel whereby the forces which would tend to make the bottom panel bulge or sag away from the strut or divider are transferred to the strut in the shear direction of the adhesive joints, the direction in which such joints are strongest. As will be apparent, the tray of this invention may be made by a simpler and more fool-proof machine and method than what is required for making previously known trays developed for similar purposes.

THE DRAWINGS

DESCRIPTION OF PREFERRED EMBODIMENT

Figure 1:
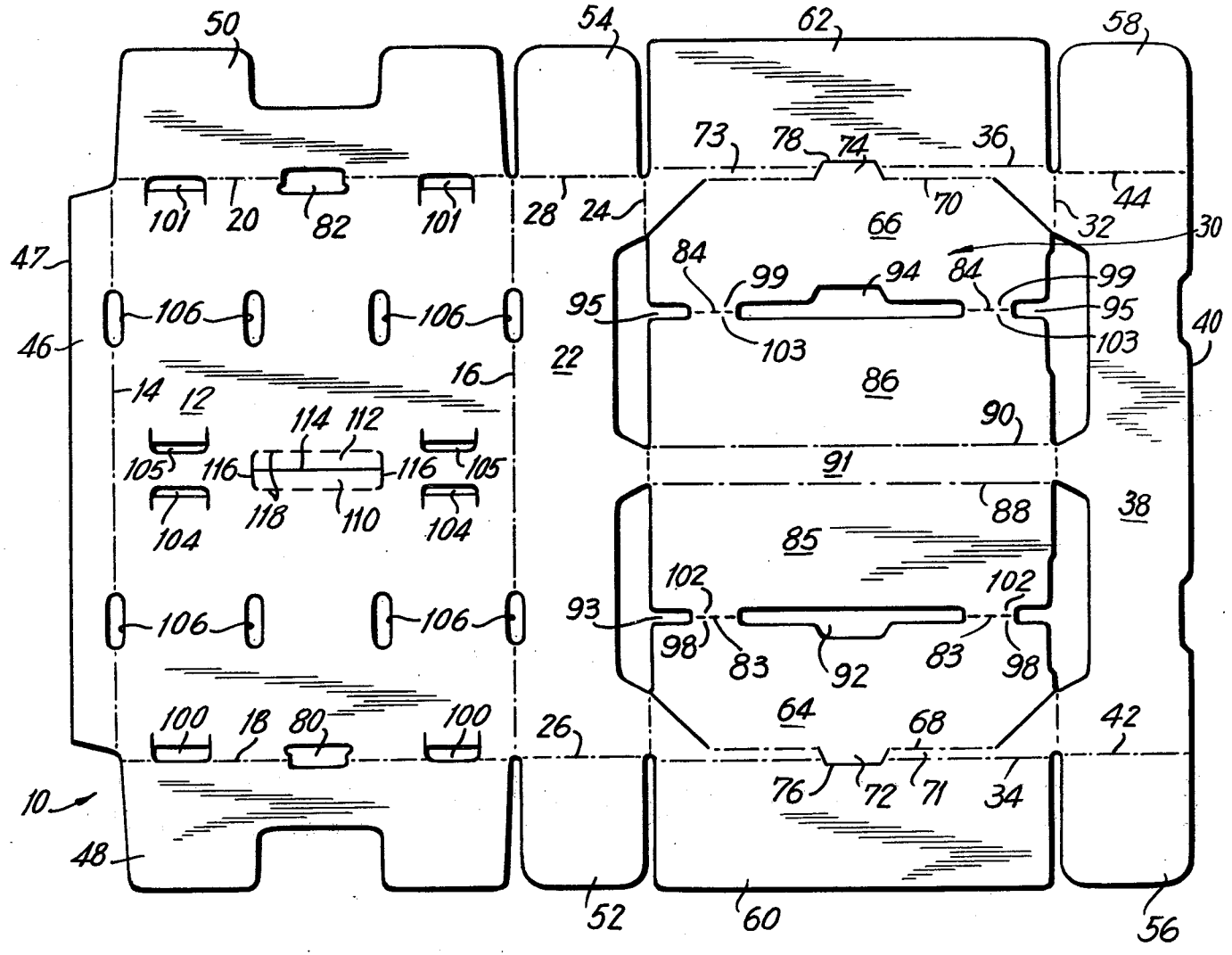
FIG. 1 is a plan view of a face of a tray blank embodying the present invention.
Figure 2:
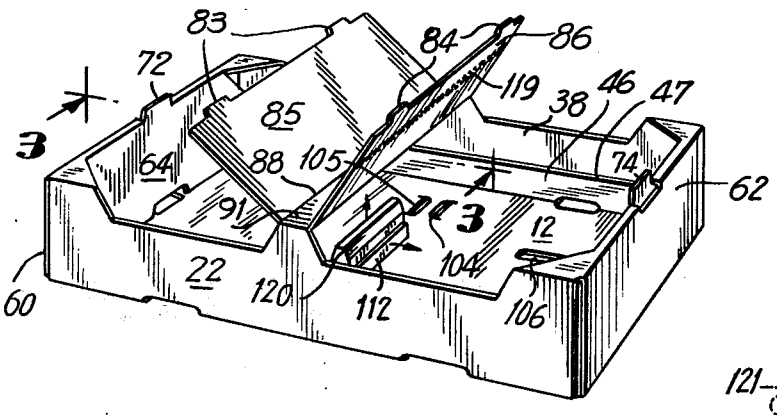
FIG. 2 is perspective view of the blank FIG. 1 partially erected into the tray of the invention.

Referring to FIG. 1 a blank 10 is shown having portions including a bottom wall panel 12 defined by side score lines 14 and 16 and end score lines 18 and 20. A side wall panel portion 22 is defined by the side score line 16, a side score line 24 and end score lines 26 and 28. A top structure or panel portion indicated at 30 is defined by the side score line 24, a side score line 32 and end score lines 34 and 36. A side wall panel portion 38 is defined by the side score line 32, a marginal edge 40 and end score lines 42 and 44. While the blank 10 may be made of any suitable paperboard, it is preferred to make it of corrugated board having at least two liners or facing boards enclosing a corrugated medium, in which event it is preferred that the flutes of the medium run lengthwise parallel with the side score lines 14, 16, 24 and 32.

A side wall glue flap 46 having an outer edge 47 is joined integrally with the bottom wall panel 12 along the side score line 14. Assuming that most of the surface of the blank 10 which is showing in FIG. 1 is to become the inside surface of the carton, the score line 16 will be folded 180 degrees upwardly and over so as to lie back upon the surface of the bottom wall panel 12. Adhesive will be applied to the thus upwardly exposed surface of the flap 46 and then the top structure 30 of the blank 10 will be folded along the side score line 32 180 degrees over onto the bottom 12 to bring the outer edge portion of the inner surface of the side wall panel 38 (the surface seen in FIG. 1) into adhesive contact with the said exposed surface of the glue flap 46. This procedure will place the blank 10 in the form of a flattened tubular blank ready to be squared up and with the glue flap 46 lying inside the blank and erected tray as seen in FIGS. 2 to 5.

Bottom end flaps 48 and 50 are integralled joined along end score lines 18 and 20, respectively, with the bottom wall panel 12. Side end flaps 52 and 54 are integrally joined along score lines 26 and 28, respectively, with the side wall panel 22 and side end flaps 56 and 58 are integrally joined along score lines 42 and 44 with the side wall panel 38.

Top end flaps 60 and 62 are integrally joined along score lines 34 and 36, respectively, with the top panel 30.

When the tubular blank 10 is first squared up, the top structure or panel portion 30 will lie in spaced parallel relation above the bottom panel 12 with the surface of the top panel 30 on the back of that shown in FIG. 1 outwardly and upwardly exposed.

After the flattened tubular blank has thus been squared up the side end flaps 52, 54, 56 and 58 will be folded inwardly through 90 degrees and the bottom end flaps 48 and 50 will thereafter be folded upwardly through 90 degrees to lie against and be adhesively secured to the said side end flaps. The top end flaps 60 and 62, finally will be folded downwardly through 90 degrees and adhesively secured to the bottom end flaps 48 and 50. Other end flaps 64 and 66 and also a pair of center wall panel flaps 85 and 86 will also be folded down inside the ends and at the center as to be further described, and glue selectively applied to the end flaps will attach all the end flaps on each end together to form strong multiple end laminations as best seen at the left end of FIG. 3. Thus, also, the top structure 30 provides portions which become vertical parts in the erected tray.

It will be recognized that some of the structure, and of the steps of squaring up and adhesive assembly of the parts are conventional and may be performed by hand or by machine as preferred. It will also be understood that before it is formed into a tube, the blank 10 is printed, cut and scored in a manner further to be described to define the several panels or portions and parts which provide both the conventional and the novel features including the open cells and the vertical center wall otherwise herein called a divider or strut which lies between adjacent cells. The embodiment shown herein provides two open cells and one divider or strut but it will be understood that a larger number of cells may be provided with a divider or strut positioned between each adjacent pair of cells.

In FIG. 1 solid lines are used to define the margins of the blank and the margins of cut-out openings which are formed by cutting and stripping. Intermittent solid lines are also used to define short intermittent cuts with substantial uncut or scored portions between to facilitate bending of carton parts during formation and erection. Intermittent solid lines are used with very short uncut portions between to facilitate separation between parts of the carton during erection. Dot-dash lines are used to define score lines.

By way of example and definition, cut-out openings or holes are formed as at 80, 82, 100, 101, 104, 105 and 106 seen in FIG. 1 by making die cuts and then stripping out the portions surrounded by the cuts, for purposes to be described.

Figure 3:
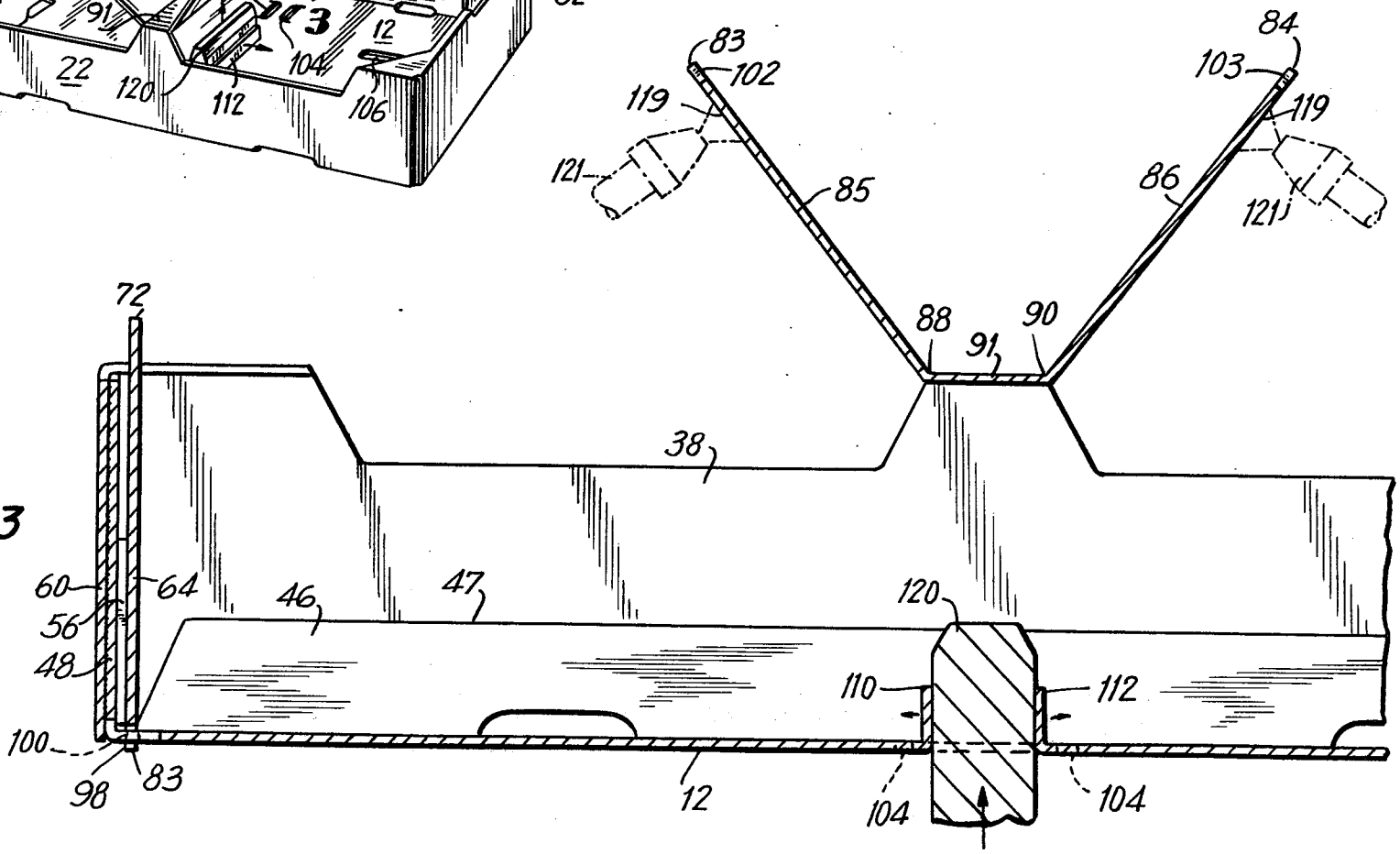
FIG. 3 is a vertical view partly in section taken along the line 3—3 in FIG. 2 and also partly in depth showing part of the back side of the partially erected tray.
Figure 6:
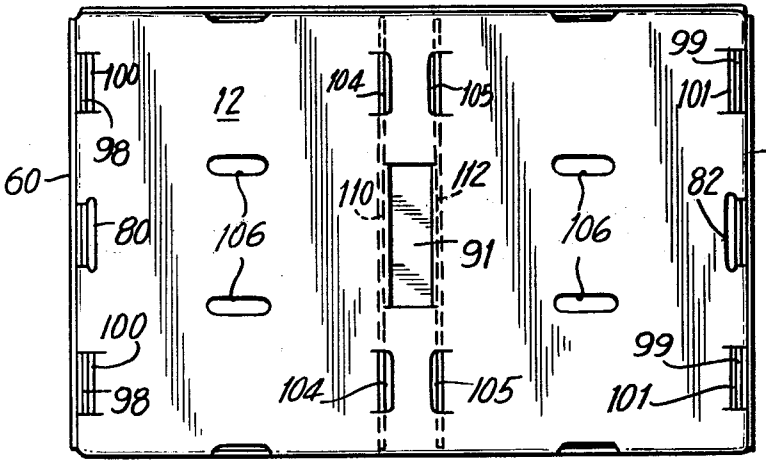
FIG. 6 is a bottom plan view of the tray of FIG. 4.

The top structure 30 of the blank 10 has inner end panel flap portions 64 and 66 which are arranged to be bent downwardly along score lines 68 and 70 after the blank 10 has first been squared up to form additional panels on the insides of the ends of the finished tray as seen on the left end of FIG. 3. Each such panel flap portion 64, 66 has a tab 72, 74 formed by cuts 76, 78. These tabs 72, 74 end up sticking up vertically from the top end surfaces of the box as seen at the left end of FIG. 3, and are arranged to fit into cut-out openings 80 and 82 seen in FIGS. 1 and 6 in the bottom of another tray above it, so that when similar trays are stacked on top of each other they are temporarily locked together by such means, in a conventional manner. It will be seen that portions 71 and 73 between the end flap score lines 34 and 68 at one end and 36 and 70 at the other end will form part of the top of the tray.

Before the inner end panel flaps 64 and 66 are bent down to help form the ends of the tray 10, they are, at least while the blank is in the condition shown in FIG. 1, part of the top structure and are attached by intermittently or partially cut break-away lines 83 and 84 to center divider wall or tubular strut panel flaps 85 and 86 which are also originally part of the top structure and, in turn, are arranged to be bent downwardly along score lines 88 and 90 located on the margins of a transverse panel 91, also part of the top structure, which forms a bridge in the finished tray. The break-away lines 83 and 84 are seen before breaking away the flaps 64 and 66 from the flaps 85 and 86 in FIG. 1, and, after erection of the tray has been started, in FIGS. 2 and 3. By comparing FIGS. 1, 2 and 3, it will be seen that, by the use of cut-outs 92, 93, 94 and 95, the break-away lines 83 and 84 define tabs 98 and 99 in the end panel flaps 64 and 66 which fit into holes formed by cut-outs 100 and 101. They also define locating tabs 102 and 103 on the center wall panel flaps 85 and 86 which fit into locating holes formed by cut-outs 104 and 105 when the tray becomes completely erected. Ventilation holes 106 are provided in the bottom of the tray 10.

Figure 5:
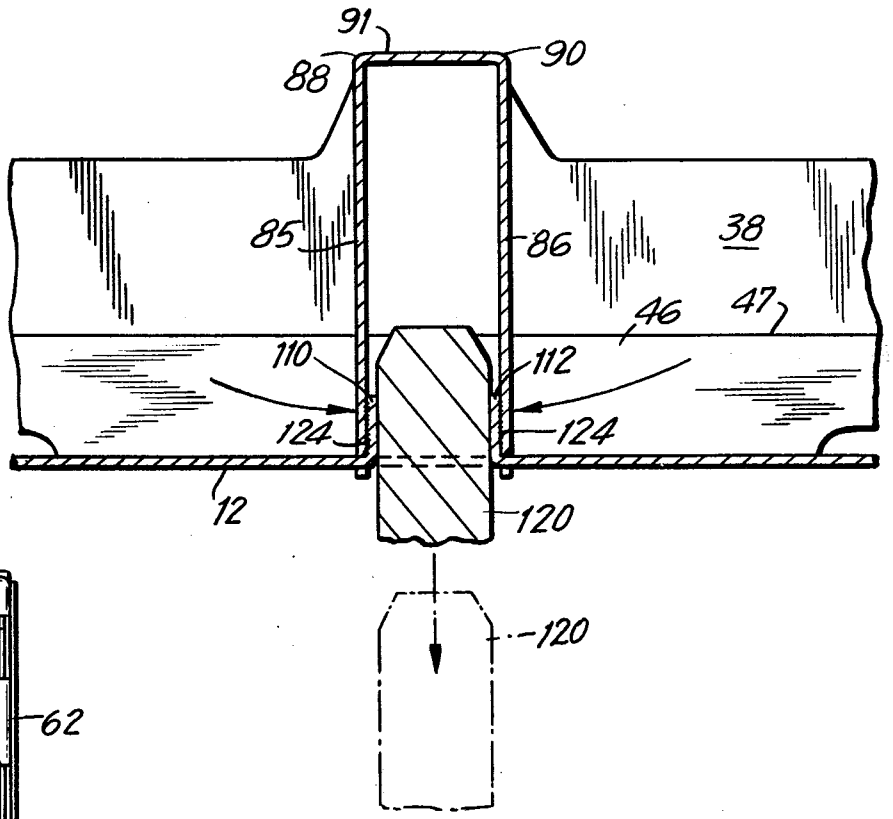
FIG. 5 is a vertical sectional view taken along the line 5—5 in FIG. 4.

The novel and inventive advance in the structure of the tray herein described is the provision of a pair of center wall tabs 110 and 112 as best seen in FIGS. 1, 3 and 5. In corrugated material there are best developed by making a longitudinal center cut 114, end cuts 116 and intermittent longitudinal marginal cuts 118, the latter to facilitate bending more readily than as provided by a conventional score line.

During the erection of the tray 10, the center wall tabs 110 and 112, after die cutting, are pushed up into a vertical position either by hand or by a mandrel 120 as may be provided in a box forming machine, as seen in FIGS. 3 and 5. The center wall panel flaps 85 and 86 are broken away from the inner end wall flaps 64 and 66 and are eventually turned down into a vertical position against the tabs 110 and 112 as seen in FIG. 5.

Means must be provided to attach the center wall flaps 85 and 86 to the tabs 110 and 112, and such means will preferably be by glueing, especially in a high speed tray erecting procedure. Accordingly, one way to do it is first to turn the center wall flaps 85 and 86 partly upwardly as seen in FIG. 3 and to apply glue lines across the under surfaces of the tabs at locations indicated at 119 as by hand or by glue guns indicated at 121. When the flaps 85 and 86 are turned down against the tabs 110 and 112, these glue lines will be on the inside surfaces of the flaps 85 and 86 and against the tabs 110 and 112 to join them together.

Several advantages result from this new structure. In prior art trays of similar function, the glue flaps are formed in what became the lower edges of the center wall flaps. This results in a "flap on a flap" which is hard to control. When glue is applied to such glue flaps, in practice, it spills in the inside of the bottom of the container as the wall flap is turned down and the glue flap turned outwardly or inwardly over or under the bottom wall and at right angles to it for attachment to the bottom. In the construction of the present tray, no such glue spillage occurs.

The center wall and bottom of the present tray are more strongly held together than those of the prior art structures because downward forces on the center of the bottom 12 of the tray are resisted by the sheer strength of the vertical glue joints between the divider wall panel flaps 85 and 86 and the tabs 110 and 112. And this sheer strength, as a principle of design, is much stronger than the tension strength of the horizontal glue joints which result in a peeling tendency in the structures of the prior art.

Figure 4:
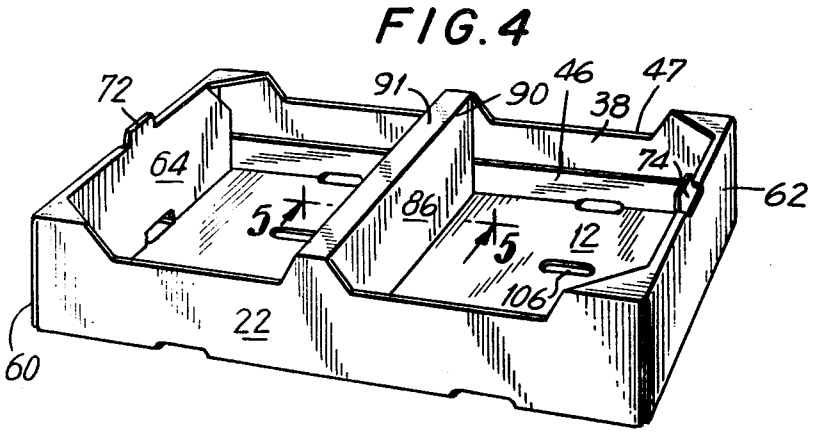
FIG. 4 is a perspective view of a completely erected tray made from the blank of FIG. 1.

The completed tray 10 is seen in FIG. 4 and its vertical center wall glue joints 122 and 124 are seen in FIG. 5. Otherwise stated, the divider wall panel flaps 85 and 86 and the tabs 110 and 112 upwardly extending from the bottom are in substantially perpendicular abutting relationship with respect to the bottom 12, but may be varied from the perpendicular.

What is claimed is:

1. A blank for forming a shipping container tray comprising at least two compartments separated by a divider wall, said blank having portions for providing, in the erected tray, top structure, a bottom, side walls, and end walls; the top structure portion including a transverse bridge part and a pair of divider wall panel flaps hingedly connected to the margins of the transverse bridge part so that when, during erection of the tray, they are turned downwardly, they extend toward the bottom of the tray, thereby forming a hollow strut; and the bottom portion having a pair of center wall tab portions arranged to be turned upwardly along hinge lines that are spaced apart a distance substantially equal to the width of the bridge part, each tab being arranged to be substantially under a margin of the bridge portion in the erected tray so that the downturned divider wall panel flaps are parallel to each other and vertical when they are secured to the center wall tab portions.

2. The blank of claim 1 wherein some of the structure of the end walls in the erected tray is comprised of panel flap portions hingedly connected to portions of the top structure.

3. The blank of claim 1 wherein the transverse bridge part and divider wall panel flaps are arranged to extend substantially from side wall to side wall in the erected tray.

4. The blank of claim 1 further comprising at least one locating tab portion on the part of the blank that becomes the lower edge of each divider wall panel flap in the erected tray, and a corresponding locating hole in the bottom portion to receive said locating tab portion when the tray is erected.

5. The blank of claim 1 wherein said blank is of corrugated paperboard.

6. The blank of claim 1 wherein said transverse bridge part and divider wall panel flaps are centrally located so as to provide two compartments of equal size in the erected tray.

7. The blank of claim 1 wherein the divider wall panel flaps are of such dimension that, in the erected tray, they extend to the bottom of the tray.

8. A shipping container tray comprising side walls, end walls, a bottom, a transverse bridge, a pair of parallel, vertical, downwardly extending divider wall panel flaps hingedly connected to said transverse bridge and forming a hollow divider wall, thus providing at least two compartments in the tray, a pair of parallel, vertical tabs hingedly connected to and upwardly extending from the bottom, said pair of tabs being arranged to be turned upwardly along hinge lines that are spaced apart at a distance substantially equal to the width of said bridge, each tab being arranged to be substantially under a margin of said bridge in said tray so that the downwardly extending divider wall panel flaps are parallel to each other and vertical when they are secured to said tabs and means securing each tab to its respective flap.

9. The shipping container tray of claim 8 wherein the divider wall panel flaps extend substantially to said bottom.

10. The shipping container of claim 8 wherein said tray is of corrugated paperboard.

11. The shipping container tray of claim 8 wherein the means securing each tab to its respective flap is an adhesive joint.

12. The tray of claim 8 wherein the transverse bridge and divider wall panel flaps extend substantially from side wall to side wall.

* * * * *